US007692541B1

(12) United States Patent
Arcaini et al.

(10) Patent No.: US 7,692,541 B1
(45) Date of Patent: Apr. 6, 2010

(54) METHOD AND APPARATUS FOR DETECTING CONTAINER BREACH VIA VISUAL CUES

(76) Inventors: Gianni Arcaini, 6622 Southpoint Dr. South Suite 310, Jacksonville, FL (US) 32216; Aydin Arpa, 6622 Southpoint Dr. South Suite 310, Jacksonville, FL (US) 32216

( * ) Notice: Subject to any disclaimer, the term of this patent is extended or adjusted under 35 U.S.C. 154(b) by 309 days.

(21) Appl. No.: 11/755,959

(22) Filed: May 31, 2007

(51) Int. Cl.
*G08B 13/08* (2006.01)

(52) U.S. Cl. ..... 340/545.6; 348/148

(58) Field of Classification Search ..... 340/545.6, 340/937, 550, 585, 590, 673, 675; 348/61, 348/143, 148, 153; 235/384
See application file for complete search history.

(56) References Cited

U.S. PATENT DOCUMENTS

| | | | | |
|---|---|---|---|---|
| 3,463,532 | A * | 8/1969 | Chidley et al. | 292/307 R |
| 4,234,926 | A | 11/1980 | Wallace et al. | |
| 5,217,307 | A * | 6/1993 | McClintock | 383/81 |
| 5,349,772 | A * | 9/1994 | Pardue | 40/590 |
| 5,755,175 | A * | 5/1998 | White et al. | 116/206 |
| 6,089,802 | A * | 7/2000 | Bullock | 410/97 |
| 6,587,046 | B2 | 7/2003 | Joao | |
| 6,832,728 | B2 * | 12/2004 | Kennedy | 235/468 |
| 7,002,472 | B2 | 2/2006 | Stratmoen et al. | |
| 7,036,729 | B2 | 5/2006 | Chung | |
| 7,047,103 | B2 | 5/2006 | Hornbacker | |
| 7,098,784 | B2 | 8/2006 | Easley | |
| 7,098,793 | B2 | 8/2006 | Chung | |
| 7,123,149 | B2 | 10/2006 | Nowak | |
| 7,136,832 | B2 | 11/2006 | Li | |
| 2004/0118316 | A1 * | 6/2004 | Grandy | 105/157.1 |
| 2006/0257005 | A1 * | 11/2006 | Bergeron et al. | 382/103 |
| 2007/0211145 | A1 * | 9/2007 | Kilian et al. | 348/148 |
| 2009/0015400 | A1 * | 1/2009 | Breed | 340/539.22 |

* cited by examiner

*Primary Examiner*—John A Tweel, Jr.
(74) *Attorney, Agent, or Firm*—Lawrence J. Gibney, Jr.

(57) ABSTRACT

This is a container breach detection system wherein a piece of material is affixed across the outside surface of container doors. When the container doors are opened, the strip will rip and cannot be repaired satisfactorily, thereby making detection of a breach much easier and much more cost effective. The material is meant to be disposable.

6 Claims, 3 Drawing Sheets

METHOD AND APPARATUS FOR DETECTING CONTAINER BREACH VIA VISUAL CUES

BACKGROUND OF THE INVENTION

A. Field of the Invention

This relates to security measures with regard to containers and detecting container breaches via visual cues while a container is moving. Containers are frequently used to transport large amounts of goods across great distances and it is important to determine if unauthorized access to the container has occurred.

B. Prior Art

There are other prior art references to container breach systems and a great many prior art references teach a radio frequency identification (RFID) tag, some of which are passive and some of which are active. This type of tag is placed on the container doors and will either signal when a breach has occurred (passive) or will allow constant monitoring of the condition of the container (active).

Representative examples of the prior art that teach types of tracking methods using RFID tags include Nowak, U.S. Pat. No. 7,123,149 and Hornbacker, U.S. Pat. No. 7,047,103. A system that teaches the tracking of goods through a variety of tracking stations can be found at Clift, U.S. Pat. No. 7,126,470.

There are other systems in the prior art that teach article tracking methods and systems including real time tracking of goods and examples of this type of device and method can be found at Chung, U.S. Pat. No. 7,036,729 and Li, U.S. Pat. No. 7,136,832. Both the Chung and Li patents use RFID technology.

The major drawback in those applications that employ RFID tags is the cost of the RFID tag. Consequently, this application is not an application for a RFID tag or a related system using an RFID tag but rather a method to track the security of containers by using visual cues. This is done not by RFID technology but by placing a strip of material across the back of the container once it has been sealed and monitoring the condition of the strip of material as it travels over great distances.

If the container doors are opened and the strip is ripped; it is made from material that will be very difficult and close to impossible to piece together. This device can be used on any type of container is significantly less costly than any methods that employ RFID tags.

BRIEF SUMMARY OF THE INVENTION

The device that is used in this method is a strip of material, which is secured to the outside of a set of container doors once the container has been closed prior to shipment.

In most containers two container doors overlap slightly in the center and a means to secure the container doors is provided typically by using a set of rods that extend from the top to the bottom of the container door. The respective ends of the rods are placed through holes in the bottom and top of the container surfaces to secure the doors. A strip of material is affixed to the outside surface of the container doors in the area of the container door overlap once the container doors have been sealed.

The strip contains adhesive on one side which will attach to the outside of the container. On the opposite side of the adhesive side the strip of material may be equipped with a specific identifying pattern or infrared reflectors for ease of detection or to make it virtually impossible to piece together the ends of the ripped strip. The condition of the strips may be captured by cameras which have been placed along a rail line route.

As an example a container is loaded on a train car prior to shipment to a destination. In a given rail system there are designated portals through which the train must pass. These portals, which are fixed structures along the rail lines, allow periodic inspection of the condition of the containers on the train by the positioning of a series of cameras near or around the portal. Cameras are positioned in the areas of the portals to examine the condition of the container from many different angles. Multiple cameras are desirable because of the speed of the train and the multitude of cars that are towed by any given train. The cameras may be equipped with infrared capability and will operate during periods of low lighting.

When a breach or attempted entry occurs, the strip will be ripped. The material that comprises the strip is made so that it will be impossible to repair the tag to its original shape. This inability to repair the strip will make detection relatively easy. A specific pattern or particular striping may also be integrated so that it will allow quicker detection of a break in the material. The material may also contain infrared markers so that the cameras will be able to detect a break in the strip in conditions of limited lighting.

As the train passes through the portals the information that is recorded by cameras will be fed to a remote station to give a visual image of the strip material on the back door of the container. If the strip is intact no breach has occurred; if the strip is ripped or frayed, a possible breach has occurred such that corrective action should be taken.

This system is particularly important when multiple containers are being shipped, as often they are, from coast to coast on rail lines. Rail lines typically move at speeds in excess of sixty miles per hour and it is important to ensure that a breach of a container does not occur somewhere along the rail line. It is also equally important to be able to detect a breach along the path of the rail line as quickly as possible so that corrective action may be taken.

As stated before, the main drawback to the widespread implementation of RFID technology is cost, particularly when multiple containers are being shipped such as by train. This device and method addresses and solves that critical issue while still providing some level of security with regard to a given container.

DETAILED DESCRIPTION OF THE EMBODIMENTS

Figure 2:
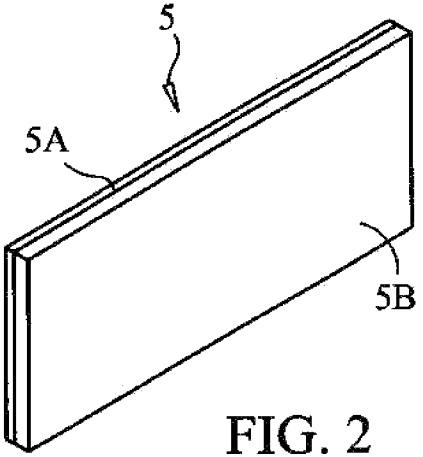
FIG. 2 is an isometric view of the strip that will be attached to the back of the container.
Figure 1:
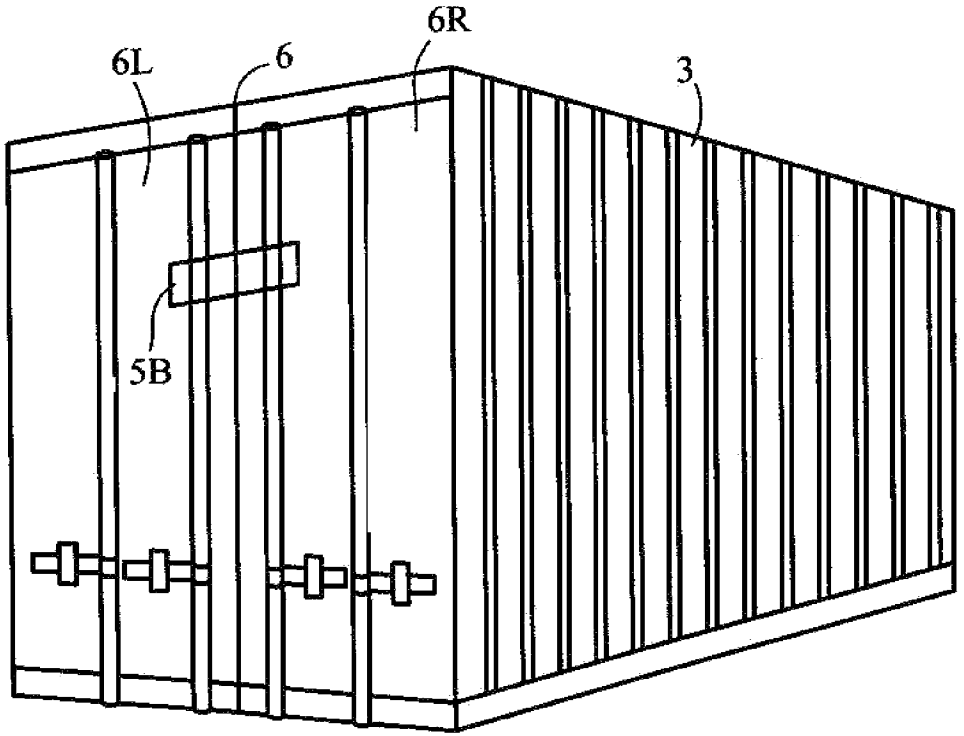
FIG. 1 is an isometric view of the device attached to the back of a container.
Figure 3:
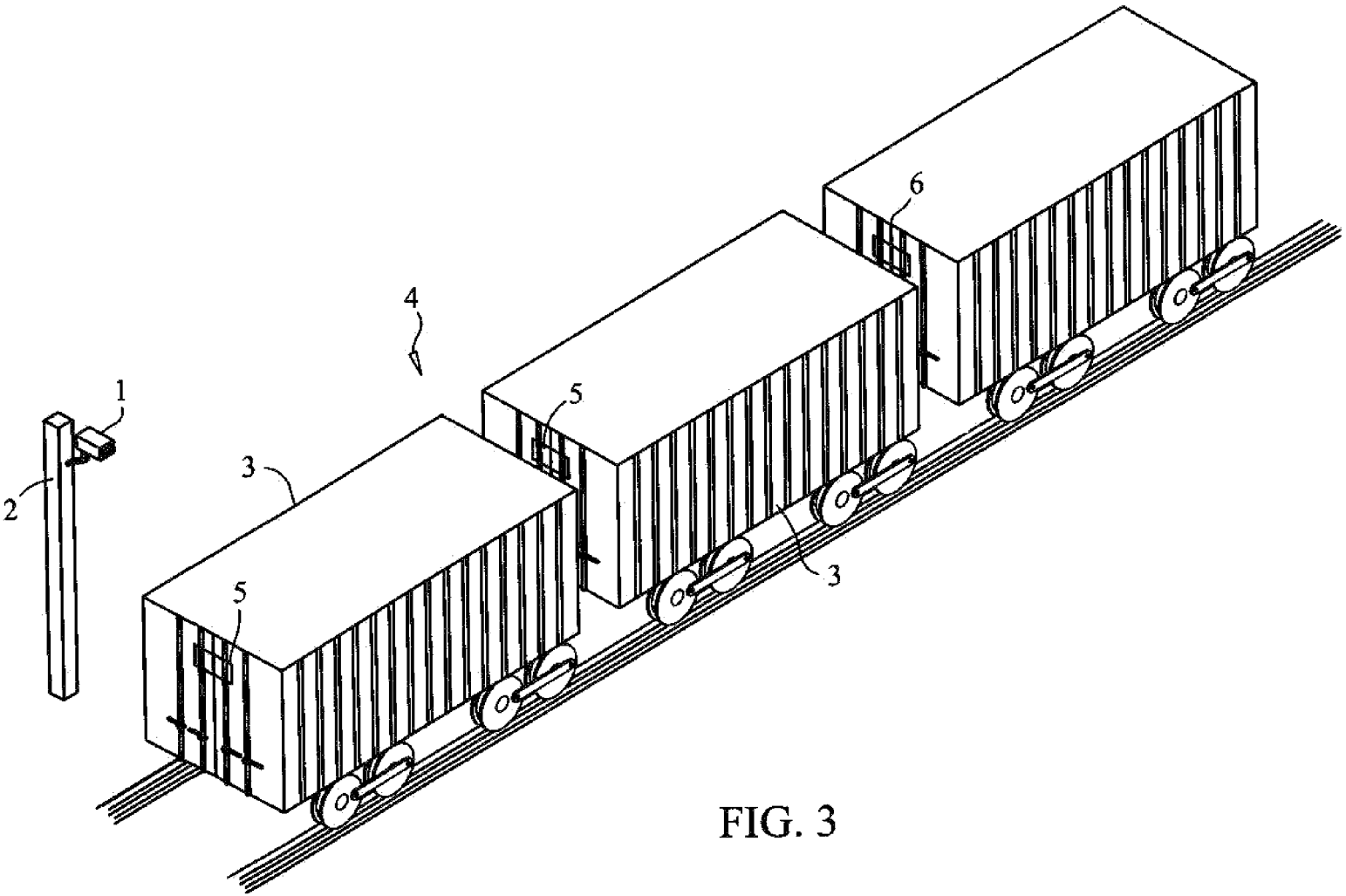
FIG. 3 is an isometric view of a group of containers on a rail line.
Figure 4:
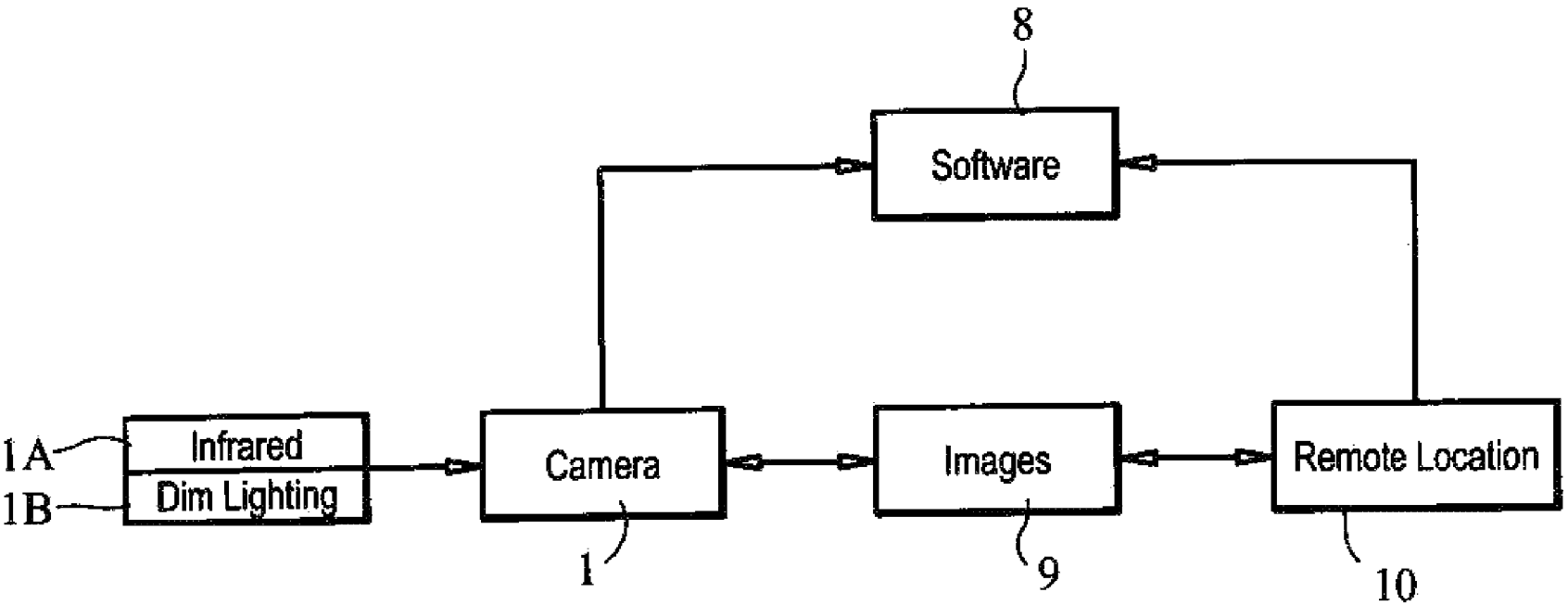
FIG. 4 is a schematic of the parts of the system.

This is a device and method to assist in the detection of a container breach. A container 3 is a box with a predetermined width, height, and length. Materials of all different types are placed in the container, and the container is then sealed, using a set of rear doors 6R and 6L, which usually extend from the top to the bottom of the back of the container. These doors are secured by a series of rods that extend from the top to the bottom of the container door and this type of securing means is common in the prior art. Access to and from the container is achieved through the rear doors, 6R and 6L. Often times, containers are locked or sealed as well as additional security precautions.

This device is a strip of material 5 which is placed across the container doors on the outside surface over the centerline of the door 6. The first side of the strip material is coated with an adhesive 5A. This strip will be affixed to the outside surface of the container doors after the container doors have been sealed over the area where the doors meet 6.

The strip 5 is applied at the departure point for the container. The second side of the strip of material may contain a reflective coating, an infrared marker or a distinctive pattern to make detection of damage to the strip easier. The strip will be made of material that will be ripped when the container doors are opened once the strip has been applied. The strip is made of material that, once broken, will not be able to be repaired to its original form thus alerting an individual that a breach may have occurred. When the strip on the container is resealed, the ends of the strip cannot be rejoined together and cannot be repaired.

During rail transport, railcars with containers move through a variety of portals 2 or fixed stations and are viewed by a series of cameras 1. The camera placement allows the viewing of the container from many different angles and the cameras are infrared sensitive 1A and can be used with low levels of lighting 1B. The images from the plurality of cameras are fed to a remote facility where it can be easily reviewed. The operator at the remote facility can view the images and easily detect any possible container breaches simply by looking at the condition of the strip of material that had been placed across the midline of the container doors prior to departure. The attendant at the remote facility or the next train stop can order corrective action in the event that there is an indication that the strip of material on the back of the container has been ripped or altered in any appreciable way.

Once the container reaches its final destination and the container doors are opened the strip of material is removed from the back of the container and disposed. A new strip can be placed on the back of the container doors prior to shipping the container to its new destination.

One of the challenges in any security system, particularly when viewing a rapidly moving object is capturing the images and integrating them into a temporal image that can be viewed and analyzed in real time. This is particularly true with a moving object such as a train, which is moving rapidly through checkpoints at speeds in excess of sixty miles per hour and particularly a train, which travels in remote locations.

The proper placement of a camera or a plurality of cameras by themselves along a route will capture the video images but will not integrate the data into a readable form at a remote facility. In the situation where the detection of container breaches is sought, it is more useful to have one image per rail car for any given train or container so as to pinpoint the location of the breach. The difficulty is that one image per rail car is not easily readable by the operator at a remote facility.

The camera images 9 from the cameras 1 at the portals 2 are integrated into software or a computer vision technique 8 like the Lucas Kanade optical flow in which a linear panorama of the moving object can be created and then forwarded to a remote facility 10. This linear panorama technique, which is found in the prior art will allow the operator to view the entire train, not just a specific car or the specific image that is captured by the camera, thus making it readable for the operator.

Once it has been determined that a breach has been identified, there is now a need to locate the exact position of the breach for law enforcement purposes.

Techniques that are used in the Lucas Kanade optical flow system can be used to identify specific locations. The information is presented for the screener at a remote facility in a readable, linear panoramic form so that the exact location can be determined and appropriate corrective action can be taken.

Additionally the images from the system including the location of any defaced or altered strip material may be archived for historical perspective or for law enforcement purposes.

The inventors claim:

1. A container breach detection system and method to use which is comprised of:

a. a strip of material;

wherein the strip of material has a first side and a second side;

wherein adhesive is placed on the first side of the strip;

wherein the first side of the strip is placed across the back surface of the container across the container doors;

wherein the strip of material is affixed to the container after the container doors have been closed and secured prior to shipment;

said strip is placed over the portion of the overlap of the container doors;

wherein the strip is constructed of material that will be broken when the container doors are opened;

b. a plurality of cameras;

wherein a plurality of cameras are placed on a plurality of portals;

said portals are fixed structures along a rail route;

wherein the plurality of cameras capture images of the containers on a train as the train passes by the portals;

wherein information from the plurality of cameras will be relayed to a remote station;

wherein the plurality of cameras will capture images of the containers as the containers travel along a rail route;

wherein the plurality of cameras will be positioned such that the plurality of cameras will capture images of the condition of the strip of material on the back of the container;

c. software;

wherein software is provided;

said software integrates the images from the plurality of cameras;

said software transmits the images to a remote location;

said software depicts the image of a train in a linear panorama;

said software is capable of inspecting the train or individual containers on the train;

said software allows the data that is collected to be stored.

2. A container breach system and method to use as described in claim 1 wherein the strip of material is equipped with a reflective coating on the second side.

3. A container breach system and method to use as described in claim 1 wherein the strip of material is equipped with infrared markers on the second side.

4. A container breach system and method to use as described in claim 1 wherein the strip of material is equipped with a distinctive pattern on the second side.

5. A container breach system and method to use as described in claim 1 wherein the strip of material is constructed of material that cannot be repaired once broken.

6. A container breach system and method to use as described in claim 1 wherein the cameras are infrared sensitive.

* * * * *